US006082961A

United States Patent [19]

Anderson et al.

[11] Patent Number: 6,082,961

[45] Date of Patent: Jul. 4, 2000

[54] PLATFORM COOLING FOR GAS TURBINES

[75] Inventors: Gordon Anderson, Baden, Switzerland; Kenneth Hall, Gainsville, Ga.; Michael Hock, München, Germany; Fathi Tarada, Kehrsatz, Switzerland; Bernhard Weigand, Waldshut-Tiengen, Germany

[73] Assignee: ABB Alstom Power (Switzerland) Ltd., Baden, Switzerland

[21] Appl. No.: 09/152,516

[22] Filed: Sep. 14, 1998

[30] Foreign Application Priority Data

Sep. 15, 1997 [EP] European Pat. Off. ..... 97810660

[51] Int. Cl.[7] ..... F01D 25/08

[52] U.S. Cl. ..... 415/115; 415/116; 415/176; 415/185; 416/193 A

[58] Field of Search ..... 415/115, 116, 415/176, 191, 183, 185; 416/97 R, 189, 193 A; 60/39.75

[56] References Cited

U.S. PATENT DOCUMENTS

| | | | |
|---|---|---|---|
| 4,126,405 | 11/1978 | Bobo et al. | 415/115 |
| 4,821,522 | 4/1989 | Matthews et al. | 60/757 |
| 5,417,545 | 5/1995 | Harrogate | 415/115 |
| 5,470,198 | 11/1995 | Harrogate et al. | 415/115 |

FOREIGN PATENT DOCUMENTS

| | | |
|---|---|---|
| 0037897A1 | 10/1981 | European Pat. Off. . |
| 2119027 | 11/1983 | United Kingdom . |
| 2122690 | 1/1984 | United Kingdom . |

*Primary Examiner*—Edward K. Look
*Assistant Examiner*—Ninh Nguyen
*Attorney, Agent, or Firm*—Burns, Doane, Swecker & Mathis, L.L.P.

[57] ABSTRACT

Platform cooling having a guide-blade platform (30; 60) which is subjected to a hot-gas stream (20) and is separated by a gap (36; 66) from a combustion-chamber segment (40; 70) arranged upstream, one or more segment cooling bores (42; 72) being made in the combustion-chamber segment (40; 70), which segment cooling bores (42; 72) connect a cooling-air chamber (44; 74) to the gap (36; 66). The guide-blade platform (30; 60) has a surface (34; 64) on the downstream side in the region of the gap (36; 66), the axes of the one or more segment cooling bores (42; 72) running roughly tangentially to said surface (34; 64).

16 Claims, 5 Drawing Sheets

PLATFORM COOLING FOR GAS TURBINES

BACKGROUND OF THE INVENTION

1. Field of the Invention

The present invention relates in general to gas turbines. In particular, it relates to- a platform cooling system having a guide-blade platform which is subjected to a hot-gas stream and is separated by a gap from a combustion-chamber segment arranged upstream.

2. Discussion of Background

In order to achieve a maximum turbine output, it is advantageous to work at the highest possible gas temperatures. In modern gas turbines, the temperatures are so high that many components have to be cooled, since otherwise the temperature of the components which is permissible for maximum durability would be exceeded. A suitable design and/or cooling of critical components is therefore of crucial importance in modern gas turbines. The cooling problem of platforms occurs to an increased extent in annular combustion chambers, since the latter produce a very uniform radial temperature profile at the entry to the turbine.

On account of the radially more uniform temperature profile at the turbine inlet, the thermal loading of the turbine components attached there, such as, for instance, the platforms and shroud bands, increases. In particular the platforms of the inlet guide blades directly at the turbine inlet are subjected to an extremely high thermal stress. From the combustion chamber, hot gas penetrates into the intermediate spaces between the last combustion-chamber segments and the platforms of the inlet guide blades and loads the components there to a considerable extent. Whereas the blades and the surfaces directly subjected to the hot-gas stream are adequately cooled as a rule and are made of temperature-resistant materials, this often does not apply to the inner surfaces of the gap. This leads to a reduced service life, and often also to damage to the components adjoining the gap. On the other hand, if the operating temperature of the hot gas is reduced, this results in reduced efficiency of the turbine.

SUMMARY OF THE INVENTION

Accordingly, one object of the invention is to provide a novel cooling arrangement for the guide-blade platforms subjected to a hot-gas stream, which cooling arrangement, with the simplest possible means, effectively reduces the thermal loading of these platforms, in particular at the front side acted upon by the hot-gas stream.

In front of each guide blade, a region of high pressure forms in the homogeneous hot-gas stream, whereas the pressure between the guide blades is lower than the average pressure. In front of each guide blade, this results in a bow wave of maximum pressure directly in front of the nose of the blade. The dynamic pressure in front of the nose is higher than the pressure in the intermediate space between the last combustion-chamber segment and the guide-blade platform. The hot gas therefore flows radially into the intermediate space and along the circumference of the combustion chamber away from the blade. In a region between the blades, the pressure in the intermediate space is greater than on the platform, and the hot gas flows there out of the intermediate space again. This inrush of hot gas into the gap between combustion-chamber segment and platform leads to high thermal loading of the insides of the combustion-chamber segment, the platform and their carrier.

The platform cooling according to the invention provides a remedy here. The guide-blade platforms which are subjected to the hot-gas stream are separated from the last segments of the combustion chamber by a gap. According to the invention, by suitable geometric arrangement of combustion-chamber segment and platform and/or by suitable cooling bores being made, the inrushing hot-gas stream is interrupted and diluted by the cooling-air stream.

According to the invention, one or more segment cooling bores are made in each combustion-chamber segment. These segment cooling bores connect a cooling-air chamber, preferably located in the region of the combustion-chamber segment, to the gap and thus direct cooling air into the intermediate space between combustion-chamber segment and guide-blade platform. According to the invention, the surface of the guide-blade platform, adjacent to the gap, on the downstream boundary of the gap is now configured in such a way that the axes of the segment cooling bores run roughly tangentially to said surface. The cooling-air flow discharging from the segment cooling bores is thus not restricted to the region of the gap but, on account of the small angle, flows with little resistance virtually tangentially over said surface of the guide-blade platform to the platform surface subjected to the hot gas. The cooling air therefore flows against the hot gas rushing into the gap and thus reduces the inrush and dilutes the hot gas with cooler gas. In addition, the cooling air discharges from the gap at a small angle and supplies the platform outside subjected to the hot gas with a cooling film. Due to the small angle, vortices and thus aerodynamic losses are kept as small as possible.

The platform cooling according to the invention can be applied equally to outer and inner guide-blade platforms. In order to describe the invention in more detail, various angles of the parts of the platform cooling, which are measured relative to the horizontal, are introduced below. In this case, for the purposes of the description, the platform is oriented in side view in such a way that the direction of view, the surface normal to the platform and the direction of the hot-gas stream form a right-handed system. The horizontal plane is spread out by the direction of view and the direction of the hot-gas stream. As usual, the angles are measured as positive in the anticlockwise direction and as negative in the clockwise direction. A standard description for outer and inner platforms is possible by these conventions. The following explanations relate equally to outer and inner platforms.

In the platform cooling according to the invention, the axes of the segment cooling bores of the combustion-chamber segment form an angle $\delta$ with the horizontal, and the above-described surface of the guide-blade platform is preferably designed in such a way that it encloses an angle $\beta$ with the horizontal in the region of the gap. In one aspect of the invention, the segment cooling bores and the surface are now matched to one another in such a way that $\delta$ is between about $\beta+10°$ and about $\beta-40°$, preferably between about $\beta$ and $\beta-30°$. The segment cooling bore is therefore usually inclined slightly further toward the horizontal than the surface of the guide-blade platform in the region of the gap and remains within 40°, preferably within 30°, of the angle of the surface. This ensures that the discharging cooling-air stream sweeps along the surface at a small angle.

Both the platform cooling bores and the segment cooling bores may be designed as cylindrical bores or as funnel bores, that is as cylindrical bores having a funnel-shaped opening. Due to the use of funnel bores, the width covered by the discharging cooling air can be greatly enlarged and thus the risk of a local inrush of hot gas can be markedly reduced. Furthermore, the design as funnel bores leads to a lower discharge velocity of the cooling jet and thus to very low aerodynamic losses.

In a further aspect, one or more platform cooling bores are additionally made in the guide-blade platform, the axes of which platform cooling bores enclose an angle $\alpha$ with the horizontal. These platform cooling bores connect a cooling-air chamber, preferably located in the region of the guide-blade platform, to the gap. In this case, it is preferable for the angle $\alpha$ to be smaller than or about the same size as the angle $\beta$. At the same time, it is even possible for $\alpha$ to have an opposite sign to $\beta$, that is for $\beta$ to be positive and a negative.

In a further aspect of the invention, a lip is advantageously made on the combustion-chamber segment and extends over the gap in the direction of the guide-blade platform. This lip reduces the effective cross section of the gap and thus reduces the inrush of hot gas. In the invention, the lip covers about 5% to about 70%, preferably about 10% to about 60%, of the gap width. The lip is subjected to high thermal loading by the hot-gas stream and is therefore advantageously cooled by the cooling-air stream of the segment cooling bores. The lip is extended over the gap as far as possible, as long as the cooling is sufficient to prevent the lip from being burned off.

In a further embodiment, the regions of the combustion-chamber segment which are acted upon by the cooling-air stream of the platform cooling bores advantageously have a concave recess or a concave curvature. On the one hand, this may be a recess in an otherwise plane surface; on the other hand, the inner surface of the combustion-chamber segment itself may also have a concave curvature. This is advantageously done in a configuration having a lip in such a way that the concave curvature merges into the lip.

The cooling-air stream is deflected by the recess as well as by the curvature and directed in the direction of the surface subjected to the hot gas. The platform cooling bores and segment cooling bores are preferably arranged in such a way that their cooling-air streams do not intersect, so that as few vortices as possible arise. This is achieved by a varying radial position of the bore openings and/or by an alternating arrangement of platform and segment cooling bores in a direction perpendicular to their axes, that is along the circumference of the annular combustion chamber. A varying radial position of the bores is advantageously formed in such a way that the regions of the combustion-chamber segment which are acted upon by the cooling-air stream of the platform cooling bores lie further away from the surface subjected to the hot-gas stream than the openings of the segment cooling bores.

Since it has been found that the inrush of hot gas depends to an extremely high degree on the size of the gap, a further aspect of the present invention consists in minimizing, where possible, the gap width between combustion-chamber segment and guide-blade platform by various measures during production. In addition, it is advantageous to arrange the combustion-chamber segment and the platform in such a way that the gap width changes as little as possible during operation, that is with due regard to the thermal expansions of the various components. It is thus advantageous if the combustion-chamber segment and the platform are fastened to a common carrier. Furthermore, machine templates, which permit true-to-size machining of, for instance, the lip and the attachment hooks, are advantageously used during the production of the parts. In addition, reference points close to the critical elements, such as, for instance, the lip, are advantageously used during the machining. A gap width of less than 5 mm, preferably less than 2 mm, is achieved by such measures and additional measures which are within the ability of the person skilled in the art.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Only the elements essential for the understanding of the invention are shown. Not shown, for example, are the complete guide-blade ring, the combustion chamber and the exhaust-gas casing of the gas turbine with exhaust-gas tube and stack.

DESCRIPTION OF THE PREFERRED EMBODIMENTS

Figure 1:
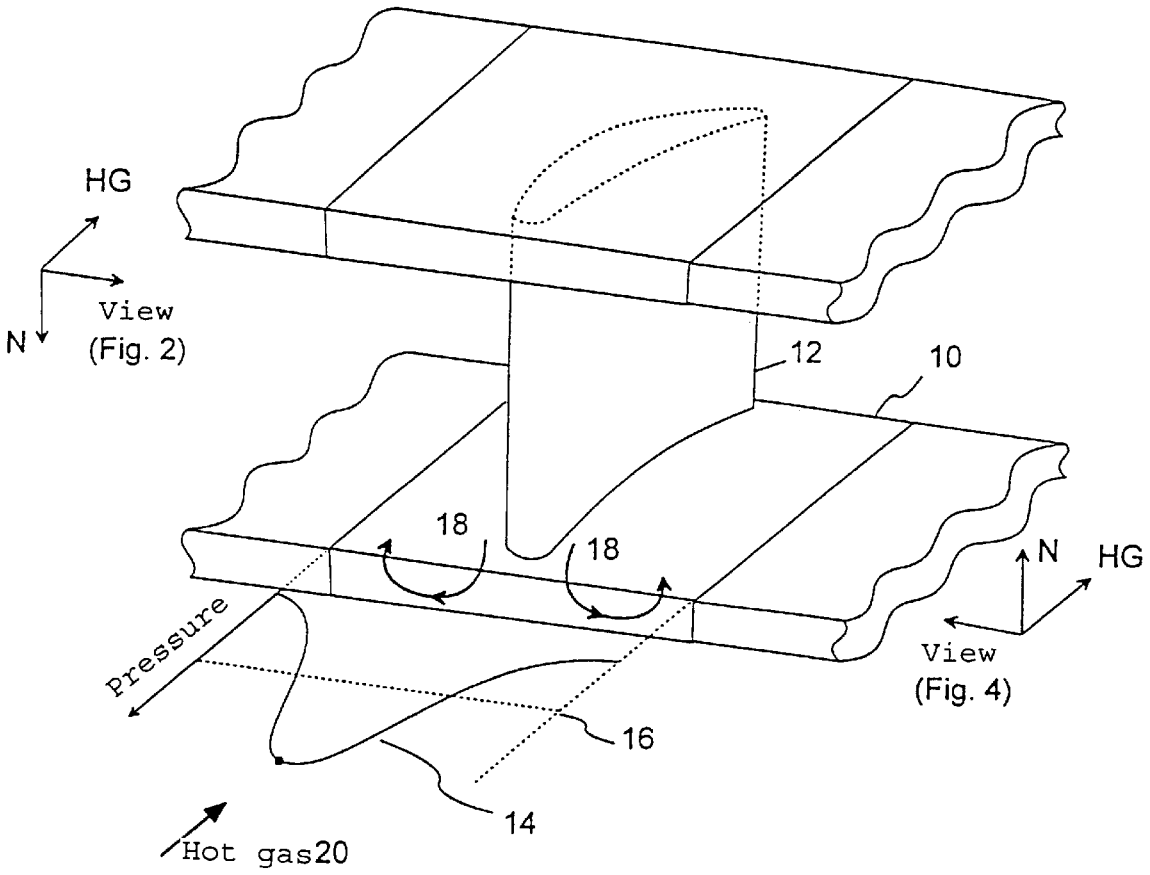
Fig 1 (prior art)
FIG. 1 shows a schematic perspective view of the guide-blade platforms of a gas turbine.

Referring now to the drawings, wherein like reference numerals designate identical or corresponding parts throughout the several views, FIG. 1 shows in a schematic view, a plurality of guide-blade platforms 10 according to the prior art. A blade element 12 which deflects the hot-gas stream 20 coming from the combustion chamber is located between one top and one bottom platform 10 each. In front of each guide blade 12, a zone 14 of maximum pressure forms directly in front of the leading edge of the blade. The dynamic pressure in front of the leading edge is higher than the average pressure 16 in the intermediate space between the last combustion-chamber segment and the guide-blade platform 10. At the bottom platforms, the hot gas flows radially inward into the intermediate space (reference numeral 18) and along the circumference of the combustion chamber away from the blade. At the top platforms, the hot gas accordingly flows radially outward into the intermediate space. In a region between the blades, the pressure 16 in the intermediate space is greater than on the platform, so that the hot gas flows out of the intermediate space there. This inrush 18 of hot gas leads to high thermal loading of the surfaces adjacent to the gap. Thus, for example, the adjoining guide-blade carrier is often made of low-alloy steel and is considerably less heat-resistant than the components subjected directly to the hot-gas stream.

Figure 2:
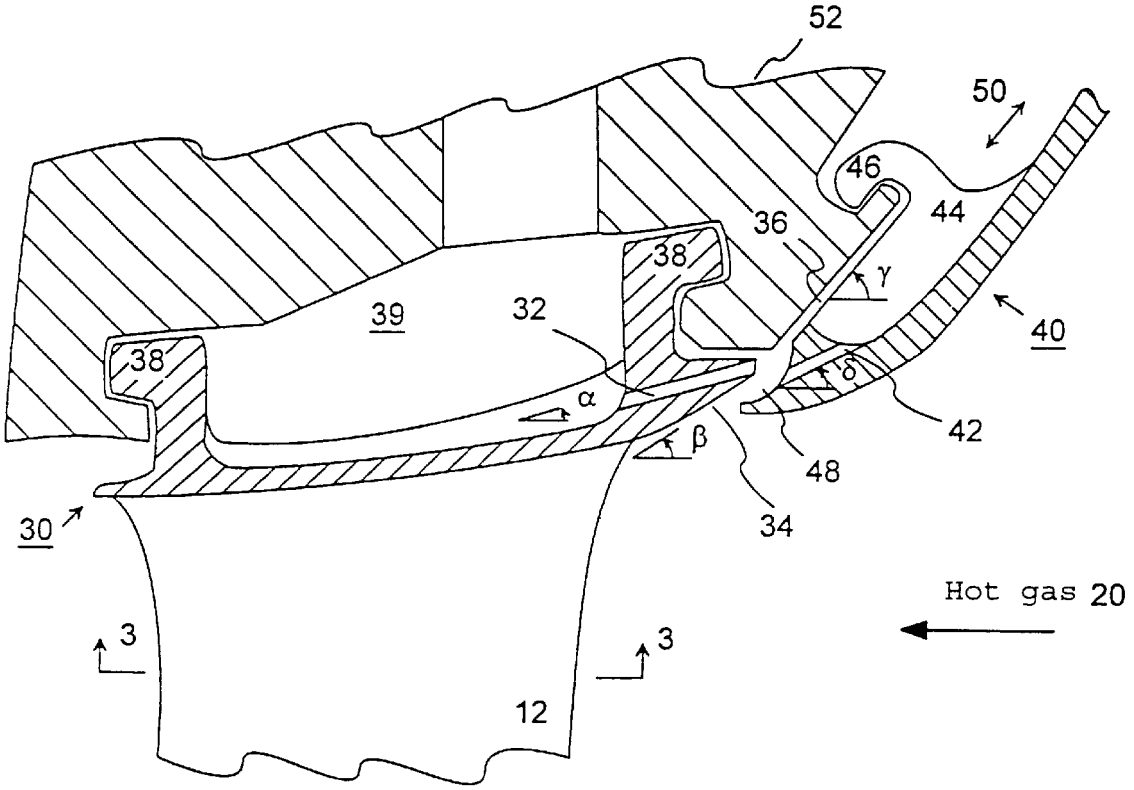
FIG. 2 shows a side view of a guide-blade platform in an exemplary embodiment of the invention.

FIG. 2 shows a side view of an exemplary embodiment of a platform cooling according to the invention for a top platform 30. The direction of view and orientation of the platform for the correct definition of the angles which occur is shown on the left in FIG. 1. In this case, the direction of view ("view (FIG. 2)"), the surface normal to the platform ("N") and the direction of the hot-gas stream ("HG") form a right-handed system as shown in FIG. 1. FIG. 2 shows a top platform 30, a combustion-chamber segment 40, a guide-blade carrier 52 and a blade element 12. The top platform 30 is separated from the combustion-chamber segment 40 by a gap 36. Both the combustion-chamber segment 40 and the platform 30 are attached in the same guide-blade carrier 52 by hooks 46 and 38 respectively.

That side of the combustion-chamber segment 40 which faces the gap 36 forms an angle $\gamma$ with the horizontal, so that the axis of the gap 36 also encloses an angle $\gamma$ with the horizontal. A row of segment cooling bores 42 connects the cooling chamber 44 to the gap 36, each of the axes enclosing an angle δ with the horizontal. That surface of the platform 30 which faces the gap is configured in such a way that it forms an angle β with the horizontal (reference numeral 34). The angles β and δ are selected in such a way that the segment cooling bores are inclined slightly more toward the horizontal than the surface 34, but the cooling-air stream of the segment cooling bores 42 flows approximately tangentially along the surface 34. In the present exemplary embodiment, δ is selected to be about 25° and β is selected to be about 30°. The cooling-air stream of the segment cooling bores 42 therefore flows at a small angle along the surface 34 and reaches that surface of the platform 30 which is subjected to the hot-gas stream 20.

Made in the platform 30 is a row of platform cooling bores 32 which connect the cooling chamber 39 to the gap 36, each of the axes of the platform cooling bores enclosing an angle α with the horizontal. A concave recess 48 is made in that region of the combustion-chamber segment which is acted upon by the cooling-air stream of the platform cooling bores, and this recess 48 deflects the cooling-air stream and directs it in the direction of the volume subjected to the hot-gas stream.

According to the invention, the angles a, α, β, γ, are selected in such a way that β lies between α and γ. In the present exemplary embodiment, γ is about 45°, β is about 30° and α is about 20°. This selection of the relationships between the angles γ and β ensures that the gap width is not substantially influenced by geometric tolerances and/or by displacements caused by thermal expansions (reference numeral 50).

Figure 3:
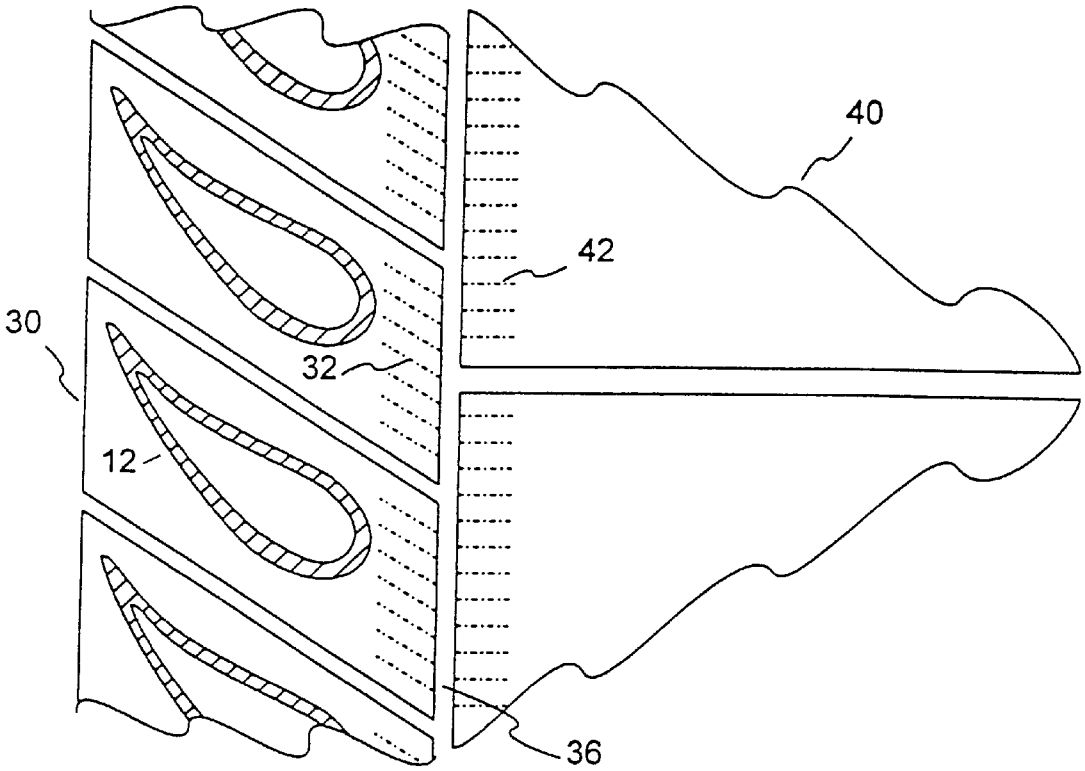
FIG. 3 shows a bottom view of the platform in direction 3—3 from FIG. 2.

The position of the axes of the segment cooling bores 42 and the platform cooling bores 32 along the circumference of the annular combustion chamber is shown in the bottom view of FIG. 3. The bores are arranged alternately and so as to be staggered relative to one another along the circumference. In addition, as shown in FIG. 2, they are also staggered radially relative to one another. These measures ensure that the cooling-air streams of the segment cooling bores 42 and the platform cooling bores 32 do not intersect, so that vortices and thus aerodynamic losses are avoided as far as possible.

Both the platform cooling bores 32 and the segment cooling bores 42 may be designed as cylindrical ores or as funnel bores. An advantage of the use of funnel bores is the wider covering of the cooling film and the lower discharge velocity of the cooling jet from the bores. The low discharge velocity results in very low aerodynamic losses.

Figure 4:
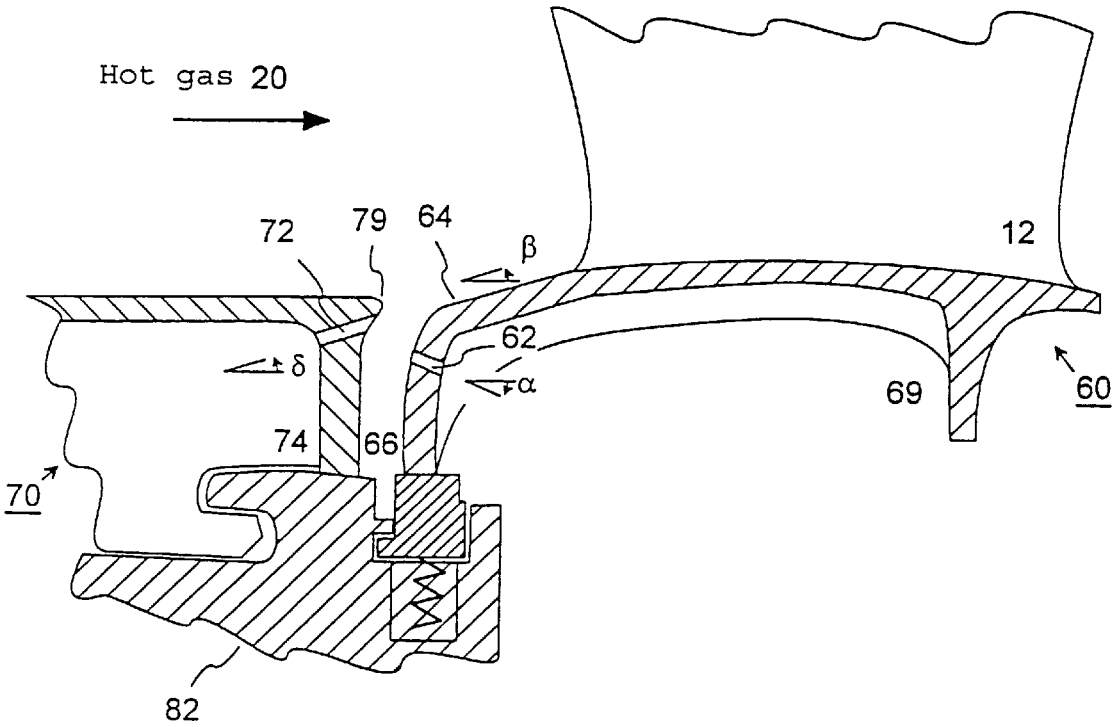
FIG. 4 shows a side view of a guide-blade platform in a further exemplary embodiment of the invention in the direction of view specified in FIG. 1.

FIG. 4 shows a side view of an exemplary embodiment of platform cooling according to the invention for a bottom platform 60. The direction of view and orientation of the platform for the correct definition of the angles which occur is shown on the right in FIG. 1. In this case, the direction of view ("view (FIG. 4)"), the surface normal ("N") and the direction of the hot-gas stream ("HG") form a right-handed system as shown in FIG. 1. As defined further above, angles are measured as positive in the anticlockwise direction and as negative in the clockwise direction.

The bottom platform 60 is separated from a combustion-chamber segment 70 by a gap 66. The platform 60 and combustion-chamber segment 70 are fastened to a common carrier 82. A row of segment cooling bores 72 connects the cooling chamber 74 to the gap 66 at an angle δ, and a row of platform cooling bores 62 connects the cooling chamber 69 to the gap 66 at an angle α. The surface of the platform 60 encloses an angle β with the horizontal in the region of the gap (reference numeral 64). In the present exemplary embodiment, β is selected to be about 30° and δ is selected to be about 25°. As a result, the cooling-air stream of the segment cooling bores 72 flows at a small angle along the surface 64 and reaches that surface of the platform 60 which is subjected to the hot-gas stream 20. The angle α in this exemplary embodiment is selected to be about −15°. The platform cooling bores 62 thus likewise blow cooling air in the direction of the open end of the gap 66. This cooling-air stream is deflected by the lip 79 and leaves the gap essentially parallel to the hot-gas stream 20. The lip 79 stretches over the opening of the gap 66 and thus reduces its effective width. This leads to a further reduction in the inrush of hot gas into the gap 66. The lip 79 is drawn over the gap 66 as far as possible and, in order to avoid being burned off, is cooled by the cooling-air stream of the segment cooling bore 72.

Figure 5:
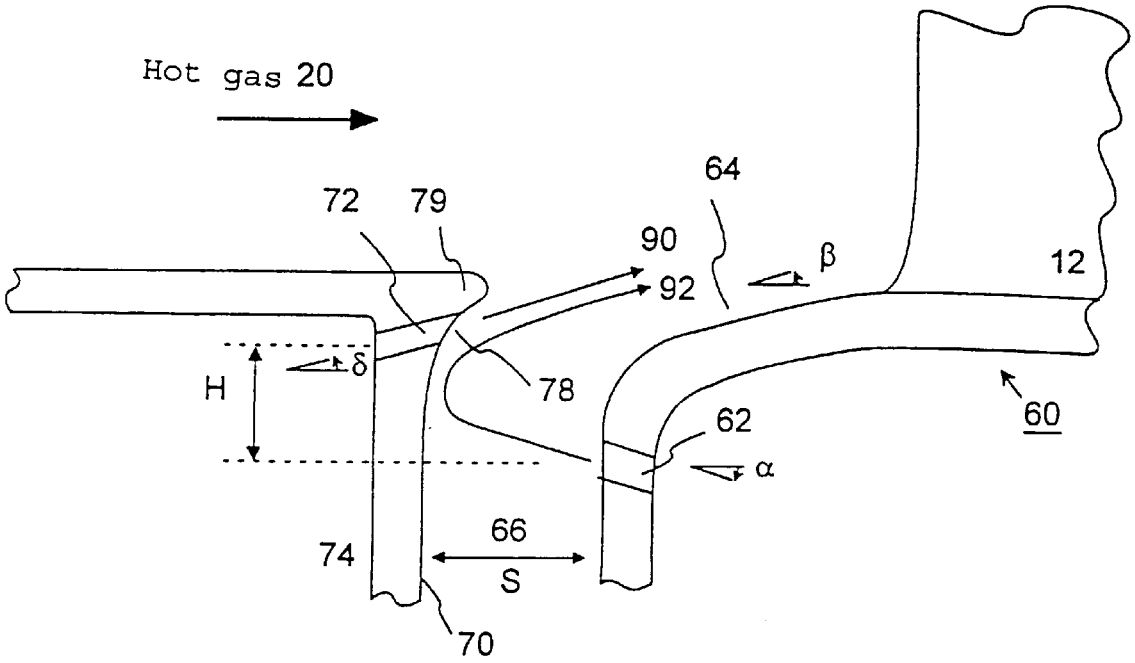
FIG. 5 shows a detail view of a guide-blade platform in an exemplary embodiment of the invention.

An advantageous arrangement of the bores and the lip of a further exemplary embodiment is shown in detail in FIG. 5. The inside of the combustion-chamber segment 70 facing the gap 66 is formed together with the lip 79 in such a way that a concave curvature 78 of the inside is obtained. The cooling-air stream 92 of the platform cooling bore 62 is thus deflected in such a way that it leaves the gap 66 roughly parallel to the hot-gas stream 20. The distance H between segment cooling bore 72 and platform cooling bore 62 is selected in such a way that the cooling-air streams 90 and 92 do not intersect. This is the case if H is selected in such a way that, at a gap width S, the angle is smaller in terms of magnitude than arctan (H/S).

In this exemplary embodiment, the position of the axes of the segment cooling bores 72 and the platform cooling bores 62 along the circumference is similar to the bottom view of FIG. 3. Here, too, the bores are arranged alternately and so as to be staggered relative to one another along the circumference, as a result of which the cooling-air streams of the segment cooling bores 72 and the platform cooling bores 62 do not intersect, so that vortices and, with them, aerodynamic losses are avoided as far as possible. Here, too, both the platform cooling bores 62 and the segment cooling bores 72 may be designed as cylindrical bores or as funnel bores.

Obviously, numerous modifications and variations of the present invention are possible in light of the above teachings. It is therefore to be understood that, within the scope of the appended claims, the invention may be practiced otherwise than as specifically described herein.

What is claimed is:

1. A platform cooling system comprising:

a guide-blade platform which is subjected to a hot-gas stream;

a combustion-chamber segment arranged upstream of the guide-blade platform, the combustion-chamber segment and the guide-blade platform being separated by a gap, the combustion-chamber segment including a cooling air chamber and at least one segment cooling bore formed in the combustion-chamber segment connecting the cooling-air chamber to the gap; and wherein the guide-blade platform has a surface adjacent to the gap on the downstream boundary of the gap configured so that the axis of the at least one segment cooling bore extends roughly tangentially to said surface:

wherein the axis of the at least one segment cooling bore encloses an angle δ with the horizontal, and said surface adjacent to the gap encloses an angle β with the horizontal, the angle δ being between about β and about (β minus 30°);

wherein the guide-blade platform includes a cooling-air chamber and at least one platform cooling bore, the at least one platform cooling bore connecting the cooling-air chamber to the gap, and the axis of the at least one platform cooling bore encloses an angle α with the horizontal, the angle α being smaller than or about the same as the angle β.

2. The platform cooling system as claimed in claim 1, wherein the segment cooling bores are cylindrical bores.

3. The platform cooling system as claimed in claim 1, wherein the platform cooling bores are cylindrical bores.

4. The platform cooling system as claimed in claim 1, wherein the segment cooling bores and the platform cooling bores are arranged alternately and so as to be staggered relative to one another in a direction perpendicular to their axes.

5. The platform cooling system as claimed in claim 1, further comprising a lip formed on the combustion-chamber segment extending in the direction of the guide-blade platform.

6. The platform cooling system as claimed in claim 5, in which the lip covers about 10% to about 60% of the gap width.

7. The platform cooling system as claimed in claim 1, wherein the combustion-chamber segment includes a side which faces the gap and includes a concave recess or a concave curvature in the regions which are acted upon by the cooling-air stream of the platform cooling bores.

8. The platform cooling system as claimed in claim 7, wherein the platform cooling bores and the segment cooling bores are arranged in such a way that the regions of the combustion-chamber segment which are acted upon by the cooling-air stream of the platform cooling bores lie further away from the surface subjected to the hot-gas stream than the openings of the segment cooling bores.

9. The platform cooling system as claimed in claim 1, further comprising a common carrier, and wherein the guide-blade platform and the combustion-chamber segment are fastened to the common carrier.

10. The platform cooling as claimed in claim 1, wherein that side of the combustion-chamber segment which faces the gap encloses an angle γ with the horizontal, the angle γ being greater than or about the same as the angle β.

11. The platform cooling as claimed in claim 1, further comprising a guide blade, the guide-blade platform attached to the guide blade as an outer platform of the guide blade, and the width of the gap is less than 5 mm.

12. The platform cooling system as claimed in claim 1, wherein the segment cooling bores are funnel bores.

13. The platform cooling system as claimed in claim 1, wherein the platform cooling bores are funnel bores.

14. The platform cooling system as claimed in claim 11, wherein the width of the gap is less than 2 mm.

15. The platform cooling system as claimed in claim 1, further comprising a guide blade, the guide-blade platform attached to the guide blade as an inner platform of the guide blade, and the width of the gap is less than 5 mm.

16. The platform cooling system as claimed in claim 15, wherein the width of the gap is less than 2 mm.

* * * * *